US005155458A

United States Patent [19]

Gamble

[11] Patent Number: 5,155,458

[45] Date of Patent: Oct. 13, 1992

[54] NORMALLY CLOSED AC RELAY

[76] Inventor: John G. Gamble, 164 North Main St., Cohasset, Mass. 02025

[21] Appl. No.: 787,060

[22] Filed: Nov. 4, 1991

[51] Int. Cl.[5] ..... H01H 51/22

[52] U.S. Cl. ..... 335/80; 335/78; 335/128

[58] Field of Search ..... 335/78-83, 335/128, 124, 131

[56] References Cited

U.S. PATENT DOCUMENTS 4,498,065 2/1985 Nagamoto et al. ..... 335/79
4,691,181 9/1987 Katsutani et al. ..... 335/128
4,937,544 6/1990 Mueller ..... 335/128

*Primary Examiner*—Lincoln Donovan
*Attorney, Agent, or Firm*—Chilton, Alix & Van Kirk

[57] ABSTRACT

A normally closed AC relay having a stator core with primary and shaded poles, an operating coil mounted on the stator core to magnetically attract a pivotal clapper in one pivotal direction thereof toward the stator pole against the bias of a return spring, the clapper and/or stator core having a reduced transverse section in the magnetic loop of the operating coil with a cross-sectional area equal to or less than that of the primary pole to control the magnetic field across the working air gap by magnetic saturation of the reduced section.

12 Claims, 2 Drawing Sheets

NORMALLY CLOSED AC RELAY

BACKGROUND OF THE INVENTION

The present invention relates generally to AC relays and more particularly to AC electromagnetic relays of the type which are closed when deenergized and which are opened as the AC current ramps upwardly to a certain level and for example which are operated by a solar photocell to automatically switch one or more outdoor lights off and on (by opening the relay when the solar light increases to a certain intensity and reclosing the relay when the solar light decreases to a certain intensity).

Photocell operated relays are commonly used for controlling street lights. To minimize the total system cost, a separate AC relay is customarily provided for each street light. Also, cost and other considerations dictate that a relay with a normally closed relay switch be used and the relay be connected to turn the light on when closed and turn the light off when open. Such an arrangement ensures that the light will be on when needed and permits using the light, if on in the daytime, to indicate a malfunction. Typically, the photocell is connected in series with the relay so that the AC voltage across the relay is dependent on the photocell resistance and thus the intensity of the light received by the photocell. As the light intensity increases, the relay current increases or ramps upwardly. As the light intensity decreases, the relay current decreases or ramps downwardly. The relay is opened when the relay current increases to a certain level and recloses when the relay current decreases to a certain lower level.

When a conventional, normally closed AC relay is operated by an upwardly ramping AC current as described, just before the AC current reaches the required level to open the relay, the relay armature can vibrate sufficiently to cause the mating contacts of the normally closed relay switch to chatter. Such incipient armature vibration and switch chatter is caused by the varying magnetic field across the working gap of the relay and the resulting ripple actuating force. In a solar photocell controlled system, such incipient armature vibration and switch chatter can occur for a significant period of time due to the gradual increase in the solar light intensity to the level required to open the relay. Also, such switch chatter can significantly reduce the operating life of the relay and the operating life of the outdoor light or other electrical device controlled by the relay. Attempts to prevent or minimize such incipient armature vibration and switch chatter have included using nickel-iron alloys for all or part of the ferromagnetic structure of the relay to flatten the permeability curve of the ferromagnetic structure, in relationship to the relay current, at the current level where such incipient switch chatter can occur. However, nickel-iron alloy parts are expensive in relationship to conventional soft iron parts due to the higher cost of the material and substantially longer annealing period required.

SUMMARY OF THE INVENTION

A principal object of the present invention is to provide a new and improved AC relay of the type described which is less likely to have incipient armature vibration and switch chatter.

Another object of the invention is to provide a new and improved AC relay of the type described which may be economically manufactured to provide reliable and repeatable operation free of switch chatter.

A further object of the invention is to provide a new and improved AC relay of the type described having a ferromagnetic structure which controls the magnetic actuation of the relay by suppressing the peaks of the ripple actuating force as the AC current ramps upwardly to the level required to open the relay.

Another object of the invention is to provide a new and improved AC relay of the type described having one or more of the foregoing benefits without resort to using special ferromagnetic alloys such as nickel-iron alloys for all or part of the ferromagnetic structure of the relay.

Other objects and advantages of the invention will become apparent from the drawings and the specification.

DETAILED DESCRIPTION OF THE PREFERRED EMBODIMENTS

Figure 1:
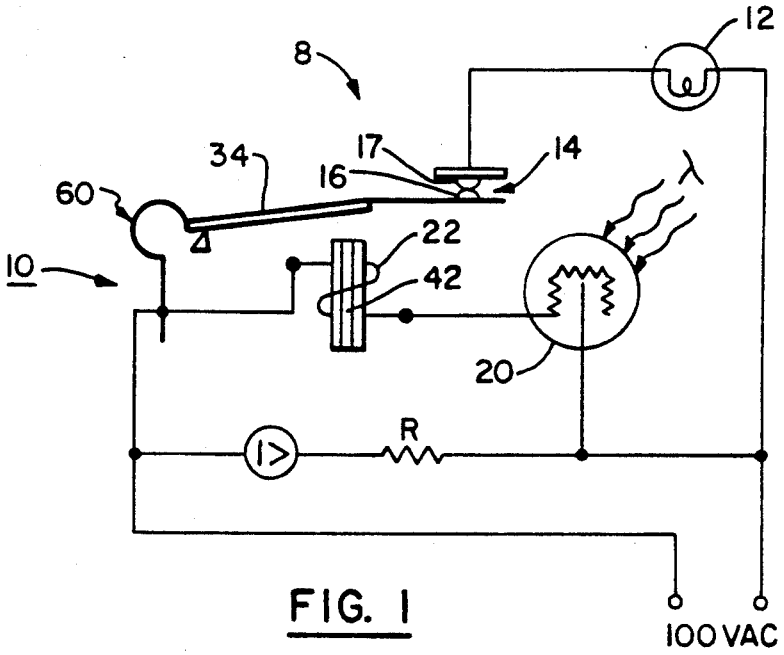
FIG. 1 is a schematic diagram of a control circuit employing an AC relay incorporating an embodiment of the present invention.

In the drawings, like numerals represent the same or like parts. FIG. 1 shows a control circuit 8 which employs an AC relay 10 incorporating an embodiment of the present invention. The AC relay 10 has a normally closed relay switch 14 with mating switch contacts 16, 17 for controlling the operation of an outdoor light 12. The relay 10 is operated by a suitable light receiving photocell 20 having a resistance which decreases as the intensity of the received light increases. The control circuit 8 is designed to be connected to any available 110 volt AC source (or in the alternative is designed to be connected to any available 220 volt AC source). The photocell 20 is connected in series with a relay operating coil 22 and the relay switch 14 is connected in series with the light 12. The light 12 is turned off by the relay 10 when the light increases to a certain intensity and is turned on by the relay 10 when the light decreases to a certain lower intensity.

Figure 2:
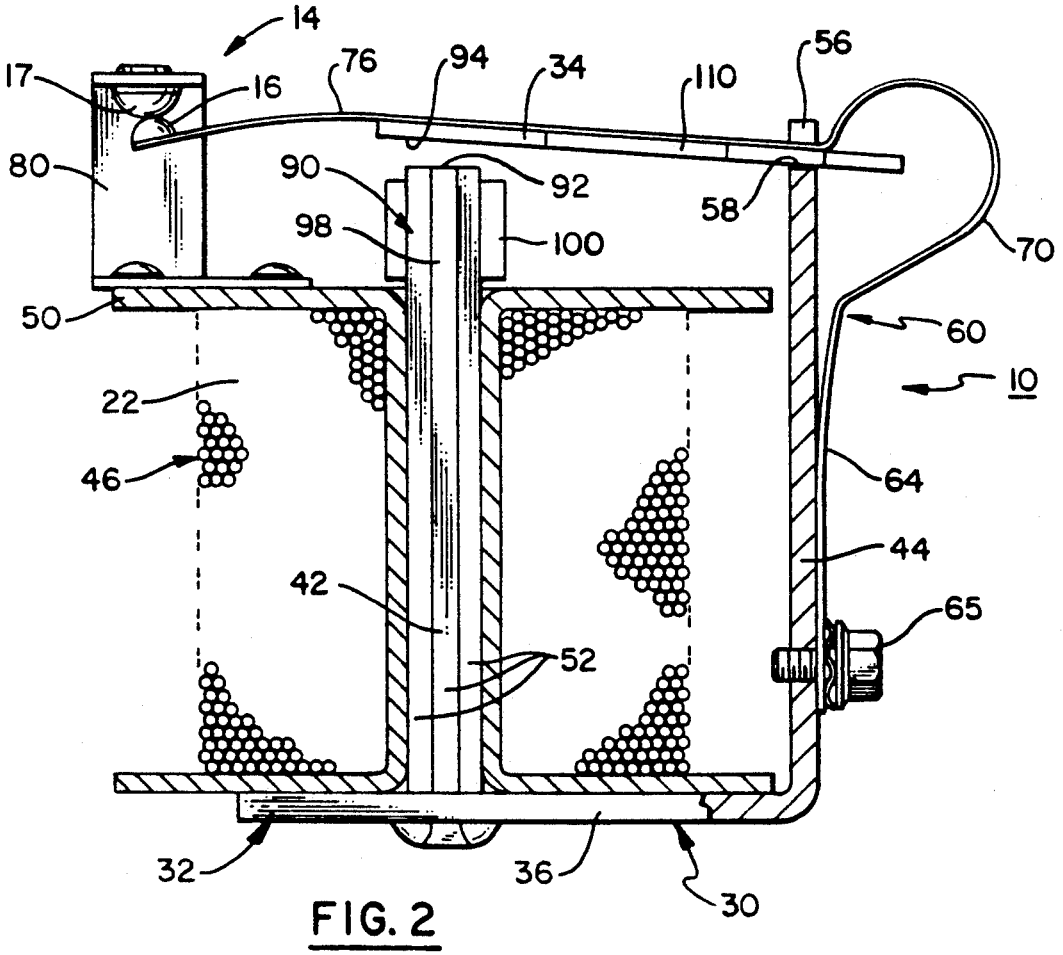
FIG. 2 is a side view, partly broken away and partly in section, of the AC relay.
Figure 3:
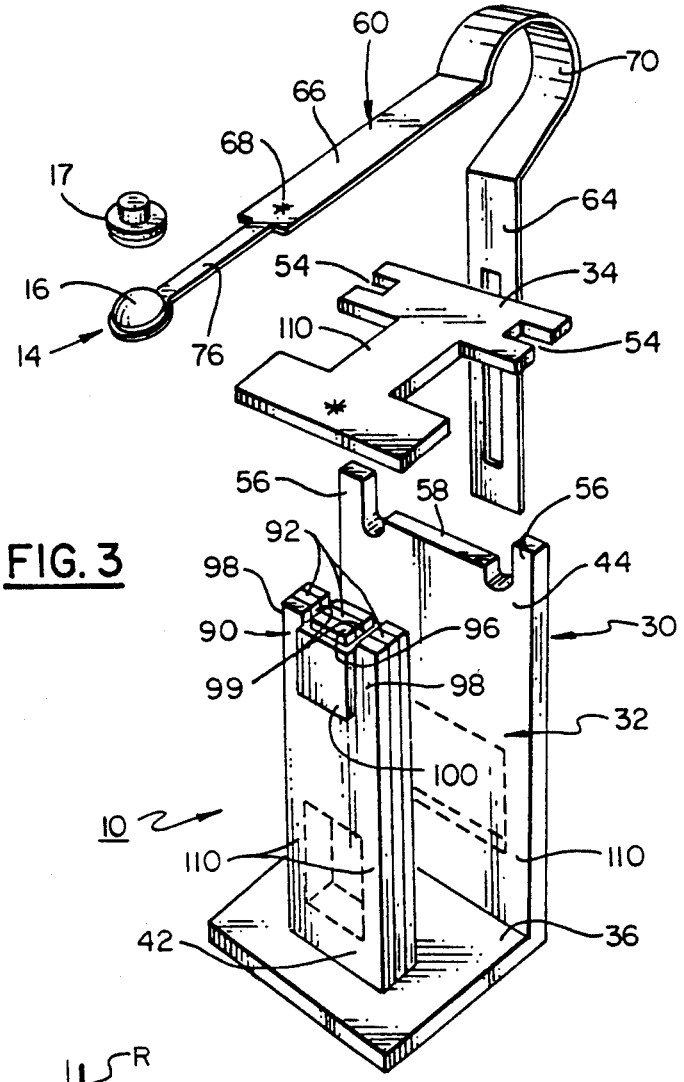
FIG. 3 is a partly exploded view, partly broken away, of the AC relay.

Referring to FIGS. 2 and 3, the relay 10 has a ferromagnetic structure 30 composed of a generally U-shaped stator core 32 and a pivotal armature or clapper 34. The U-shaped stator core 32 has a flat base plate 36 and a pair of flat, parallel side plates providing a stator pole plate 42 and field return plate 44. A coil and coil bobbin subassembly 46 is mounted on the pole plate 42. The subassembly 46 has an opening configured to receive the pole plate 42 and is securely mounted on the pole plate 42 after the coil 22 is wound on the bobbin 50. The flat pole plate 42 is shown composed of three laminations 52 which are suitably insulated (coated) and secured together and to the base plate 36. A non-laminated pole plate (not shown) may be used if desired, in which event the entire U-shaped stator core 32, including the base plate 36 and both side plates 42, 44, is preferably formed from a single stamped metal plate.

The clapper 34 is a flat stamped metal plate. The inner end of the clapper 34 and outer end of the field return plate 44 are contoured for pivotally mounting the clapper 34 on the outer end of the plate 44. For that purpose, the inner end of the clapper 34 has a pair of oppositely facing slots 54 and the outer end of the return plate 44 has a pair of upstanding, laterally spaced posts 56 received within the slots 54. A central, outer linear edge 58 of the field return plate 44 is engaged by the inner flat surface of the clapper 34 to form a pivot edge for the clapper 34. The heel reluctance between the clapper 34 and field return plate 44 remains at a relatively constant, low value throughout the full range of operation of the relay 10 and pivotal movement of the clapper 34.

An armature return spring 60 of suitable nonmagnetic material is provided by an elongated, preformed, resilient leaf spring having one flat arm 64 secured by a suitable fastener 65 to the outer face of the field return plate 44 and a second flat arm 66 spot welded at 68 to the outer face of the clapper 34. An intermediate arcuate section 70 of the leaf spring 60 provides (a) the desired spring bias for returning the clapper 34 to its normal or withdrawn limit position shown in FIG. 2 and (b) the desired spring preload on the clapper 34 in that withdrawn limit position. The return spring 60 also serves to hold the clapper 34 on the field return plate 44 with the inner flat surface of the clapper 34 in engagement with the pivot edge 58 of the field return plate 44.

The movable contact 16 of the relay switch 14 is provided on the outer end of a flat cantilevered extension arm 76 of the leaf spring 60. The fixed contact 17 of the switch 14 is provided on a fixed bracket 80 for engagement by the movable contact 16 when the clapper 34 is in its withdrawn limit position established by the fixed contact 17. The bracket 80 is made of a nonmagnetic material and is suitably fixed to the bobbin 50. The cantilevered extension arm 76 is deflected inwardly slightly as shown in FIG. 2 when the clapper 34 is in its withdrawn limit position. The movable contact 16 is thereby biased into engagement with the fixed contact 17 with a predetermined preload which helps prevent contact disengagement until the relay 10 is opened.

The outer or free end of the pole plate 42 forms a stator pole 90 with a flat outer linear edge or pole face 92. The stator pole face 92 is engageable by an inner flat pole face 94 on the outer end of the clapper 34. A predetermined working air gap is established between the pole faces 92, 94 when the clapper is in its withdrawn limit position.

The stator pole 90 is divided by one or more elongated slots 99 into a plurality of stator pole segments comprising a shaded or secondary pole segment 96 and one or more primary pole segments 98. In the shown embodiment, two parallel slots 99 are provided which form a primary pole composed of two outer primary pole segments 98 and a shaded pole composed of a central shaded pole segment 96. The cross-sectional area and pole face area of the shaded pole (provided by pole segment 96) are preferably greater than the total cross-sectional area and pole face area of the primary pole (provided by the two primary pole segments 98). The pole face area of the shaded pole is made relatively large to reduce the air gap reluctance between that pole face and the clapper pole face 94. A suitable shading ring 100 in the form of a solid, rectangular copper ring is mounted on the shaded pole segment 96 and received within the slots 99.

Figure 4:
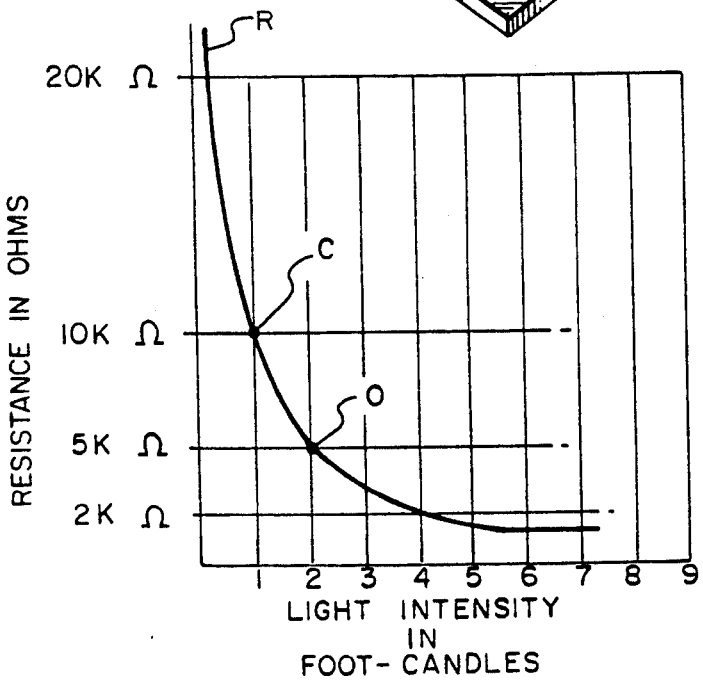
FIG. 4 is a graph illustrating the relationship between the resistance of a photocell of the control system and the intensity of light received by the photocell.

FIG. 4 shows a graph having an abscissa scale representing the intensity in foot-candles of the light received by the photocell 20 and an ordinate scale representing the resistance R of the photocell 20 in kiloohms. As shown, the photocell resistance R decreases as the light intensity increases. Thus, the AC voltage across the relay coil 22 is directly related to the intensity of the light received by the photocell 20. As the light intensity increases, the AC current ramps upwardly until the relay 10 is actuated. At the relay opening point O, the photocell resistance R has a value at which the AC current is sufficient to actuate the relay 10 and open the switch 14. At the relay closing point C, the AC current has a value at which the relay 10 is reclosed by the armature return spring 60. The photocell resistance at the closing point C is significantly greater than the resistance at the opening point O so that the AC current at point C is significantly less than that required to open the relay 10 at point O.

In accordance with the present invention, one or more transverse sections 110 of the ferromagnetic structure 30 are reduced in cross section to control the magnetic actuation of the relay 10. The reduced transverse section 110 is preferably provided on the clapper 34, for example as shown in FIG. 3 by providing opposed lateral slots on the outer edges of the clapper 34 between the pivot edge 58 and outer pole face 94. In the alternative, the reduced transverse section 110 can be formed by a central opening in the clapper 34 (not shown) or can be provided on the stator core 32. For example, a reduced transverse section 110 can be provided on the plate 42 or plate 44 by a central opening in the plate as shown in broken lines in FIG. 3 (in addition to or instead of the reduced section 110 on the clapper 34). In each instance, the reduced transverse section 110 is located in the magnetic loop or circuit of the relay coil 22 in series magnetic relationship with and between the stator pole 90 and clapper pole face 94 and thus in series magnetic relationship with the working air gap between the stator pole face 92 and clapper pole face 94. The length of the reduced transverse section 110 (e.g., one-fourth inch) is sufficient to control the ferromagnetic field by saturation and for example is approximately equal to the length of the pole segments 96, 98.

The reduced transverse section 110 is sized to saturate at approximately the same magnetic field strength as the primary pole or at a slightly lower magnetic field strength. Thus, where the entire stator core 32 and clapper 34 are made of highly permeable, relatively low cost, soft iron (e.g., where the core 32 and clapper 34 are annealed for approximately three (3) hours) or those parts are made of another ferromagnetic material or materials having the same permeability, the cross-sectional area of the reduced transverse section 110 is preferably approximately equal to or slightly less than the cross-sectional area of the primary pole (which, in the shown embodiment, is the same as the total pole face area of the two primary pole segments 98). If, for example, the stator pole plate 42 is made of a nickel-iron alloy and the rest of the ferromagnetic structure is made of soft iron, the cross-sectional area of the reduced transverse section 110, if provided in the clapper 34 or plate 44, is sized to be approximately equal to 80% of the cross-sectional area of the primary pole or to be slightly less than 80% of that area. In that regard, a nickel-iron alloy plate 42 (e.g., annealed for approximately twenty (20) hours) has a flux level at saturation which is approximately 80% of that of soft iron.

The pivotal actuation of the clapper 34 with a sinusoidal AC current is provided by a magnetic field having repeating magnetic cycles corresponding to half-waves of the AC current. Each magnetic cycle lags the corresponding half-wave of the AC current. During each magnetic cycle, three (3) magnetic fields are produced. They are hereafter called the Primary, Secondary and Tertiary Fields. The Primary Field begins when the magnetic cycle begins and thus lags the corresponding half-wave of the AC current. The Primary Field is the magnetic field through the primary pole (formed by pole segments 98) produced by the AC current and is equal in duration to the corresponding half-wave of the AC current. The direction of the Primary Field is dependent on the direction of the AC current.

The Primary Field has first and second phases. The AC current increases rapidly at the beginning of the first phase, reaches its maximum and then decreases rapidly to zero and changes direction before the end of the second phase. During the first phase, the Primary Field provides substantially the total magnetic field across the working air gap. That is so, because, during the first phase of the Primary Field, the induced shading ring current opposes a parallel magnetic field through the shaded pole 96. During the second phase of the Primary Field, the shading ring current produces a parallel magnetic field through the shaded pole 96. This parallel magnetic field through the shaded pole 96 is the Secondary Field referred to above. By definition the second phase of the Primary Field occurs at the same time as the Secondary Field.

The Secondary Field through the shaded pole 96 helps maintain the magnetic field across the working air gap at a high level as the AC current subsides. The Tertiary Field is produced at the end of each magnetic cycle after the AC current has changed direction and the AC current produces a magnetic field in opposition to the Secondary Field. The Tertiary Field, by definition, results when the field through the shaded pole 96 (produced by the residual current in the shading ring 100) is diverted (by the opposing magnetic field from the AC current) back through the primary pole. A new magnetic circuit between the stator pole 90 and clapper 34 is thereby formed. By definition, the Tertiary Field begins when the direction of the field through the primary pole is reversed. At that point, the two fields produced by the reverse AC current and the residual current in the shading ring 100 pass in the same direction through the primary pole. In effect, the Primary Field of the next magnetic cycle begins when the Tertiary Field of the preceding cycle begins. The Tertiary Field ends after the shading ring current is spent and a shading ring current in the reverse direction is induced by the opposing field produced by the AC current. The Tertiary Field occurs during a third and final phase of the magnetic cycle which follows the second phase of the Primary Field.

Control of the timing and magnitude of the three described magnetic fields controls the magnetic force on the clapper 34. This control is provided in part by sizing the primary pole so that it will saturate at a field strength reasonably above that required to overcome the bias of the return spring 60 and actuate the relay 10. The control is also provided in part by sizing the relay coil 22 to provide the ampere turns (NI) required to create a Primary Field of sufficient strength to actuate the relay at the desired AC current level.

The control is also provided in part by sizing the reduced transverse section 110 so that it will saturate at a flux level (a) reasonably above that required to overcome the bias of the return spring 60 and actuate the relay 10 and (b) yet low enough to flatten the magnetic field, in relationship to the relay current at the point where incipient switch chatter would otherwise occur. The reduced transverse section 110 thereby provides for attenuating the magnetic spikes sufficiently to provide a clean, chatter free, switch break. The reduced transverse section 110 attenuates magnetic spikes during both phases of the Primary Field and primarily during the second phase of the Primary Field when both the Primary and Secondary Fields are produced. The latter control occurs after the AC current and the Primary Field have peaked but while the AC current is sufficiently high to produce a relatively strong Primary Field. At the same time, the magnitude of the Secondary Field is relatively strong due to the rapidly decreasing AC current. Thus, during the second phase of the Primary Field, the primary and secondary fields combine to produce a combined magnetic field having a magnitude greater than each of the component fields. Without the reduced transverse section 110, that combined field can be substantially stronger than the Primary Field at its peak. At the AC current level just before the relay is actuated to open the relay, the reduced section 110 functions to limit the flux and therefore the torque produced by that combined field. Thus, the reduced transverse section 110 flattens out the magnetic field during each magnetic cycle to minimize armature vibration and eliminate switch contact chatter.

As will be apparent to persons skilled in the art, various modifications, adaptations and variations of the foregoing specific disclosure can be made without departing from the teachings of the present invention.

I claim:

1. In an AC relay having a ferromagnetic structure with a pivotal clapper with a clapper pole face and a stator core with a stator pole with separate primary and secondary pole faces; the stator pole being composed of primary pole means and shaded pole means having said primary and secondary pole faces respectively; shading ring means encircling the shaded pole means; the pivotal clapper having a withdrawn pivotal position with the clapper pole face in opposed face to face relationship with the primary and secondary pole faces of the stator pole with a working air gap therebetween; an operating coil mounted on the stator core for producing an electromagnetic field in a magnetic loop extending through the ferromagnetic structure and across the working air gap between the opposed pole faces of the stator pole and clapper to magnetically attract the clapper in one pivotal direction thereof from its withdrawn position to an attracted position; return spring means biasing the clapper in the opposite pivotal direction with a preload bias on the clapper in its withdrawn position; a relay switch comprising a pair of cooperating switch contacts and switch contact mounting means for mounting the pair of contacts for engagement to close the switch with the clapper in its withdrawn position and for disengagement to open the switch upon pivotal movement of the clapper from its withdrawn position to its attracted position; the improvement wherein said ferromagnetic structure has a reduced transverse section in said magnetic loop in series magnetic relationship with the primary and shaded pole means, operating coil and working air gap to control the magnetic attraction of the clapper by magnetic saturation of the reduced transverse section, the reduced transverse section having a cross-sectional area related to the cross-sectional area of the primary pole means to saturate at a flux level not substantially greater than the primary pole means.

2. An AC relay according to claim 1 wherein the clapper has said reduced transverse section.

3. An AC relay according to claim 1 wherein the stator core has said reduced transverse section.

4. An AC relay according to claim 1 wherein the reduced transverse section is formed by at least one peripheral slot in the ferromagnetic structure.

5. An AC relay according to claim 1 wherein the reduced transverse section has a length approximately equal to the length of the primary pole means.

6. An AC relay according to claim 1 wherein the reduced transverse section has a length of at least approximately one-fourth inch.

7. An AC relay according to claim 1 wherein the reduced transverse section has a cross-sectional area related to the cross-sectional area of the primary pole means to saturate at a field strength less than the magnetic field strength of the primary pole means.

8. An AC relay according to claim 1 wherein the switch contact mounting means comprises first mounting means for fixing one of the pair of contacts relative to the stator core and second mounting means for mounting the other contact on the clapper.

9. An AC relay according to claim 8, wherein the second mounting means comprises a cantilevered leaf spring mounted on the clapper and having an outer free end supporting said other contact.

10. An AC relay according to claim 7 wherein the secondary pole means has a cross-sectional area not less than the cross-sectional area of the primary pole means.

11. In a photocell operated AC relay control circuit having a pair of inputs for connecting the circuit to an AC source and a photocell and AC relay connected in series between the inputs for selectively actuating the relay with the AC source in accordance with the intensity of light received by the photocell; the AC relay comprising a ferromagnetic structure with a pivotal clapper with a clapper pole face and a stator core with a stator pole with separate primary and secondary pole faces; the stator pole being composed of primary pole means and shaded pole means having said primary and secondary pole faces respectively; shading ring means encircling the shaded pole means; the pivotal clapper having a withdrawn pivotal position with the clapper pole face in opposed face to face relationship with the primary and secondary pole faces of the stator pole with a working air gap therebetween; an operating coil mounted on the stator core for producing an electromagnetic field in a magnetic loop extending through the ferromagnetic structure and across the working air gap between the opposed pole faces of the stator pole and clapper to magnetically attract the clapper in one pivotal direction thereof from its withdrawn position to an attracted position; return spring means biasing the clapper in the opposite pivotal direction with a preload bias on the clapper in its withdrawn position; a relay switch comprising a pair of cooperating switch contacts and switch contact mounting means for mounting the pair of contacts for engagement to close the switch with the clapper in its withdrawn position and for disengagement to open the switch upon pivotal movement of the clapper from its withdrawn position to its attracted position; the improvement wherein said ferromagnetic structure has a reduced transverse section in said magnetic loop in series magnetic relationship with the primary and shaded pole means, operating coil and working air gap to control the magnetic attraction of the clapper by magnetic saturation of the reduced transverse section, the reduced transverse section having a cross-sectional area related to the cross-sectional area of the primary pole means to saturate at a flux level not substantially greater than the primary pole means.

12. In an AC relay having a ferromagnetic structure with a movable armature with an armature pole with an armature pole face and a stator core with a stator pole with a stator pole face; the pole faces of one of the poles having separate primary and secondary pole faces, said one pole being composed of primary pole means and shaded pole means having said primary and secondary pole faces respectively; shading ring means encircling the shaded pole means; the armature having a withdrawn position with the armature pole face in opposed face to face relationship with the stator pole face with a working air gap therebetween; an operating coil mounted on the stator core for producing an electromagnetic field in a magnetic loop extending through the ferromagnetic structure and across the working air gap between the opposed pole faces of the stator and armature to magnetically attract the armature in one direction thereof from its withdrawn position to an attracted position; return spring means biasing the armature in the opposite direction with a preload bias on the armature in its withdrawn position; a relay switch comprising a pair of cooperating switch contacts and switch contact mounting means for mounting the pair of contacts for engagement to close the switch with the armature in its withdrawn position and for disengagement to open the switch upon movement of the armature from its withdrawn position to its attracted position; the improvement wherein said ferromagnetic structure has a reduced transverse section in said magnetic loop in series magnetic relationship with the primary pole means, shaded pole means, operating coil and working air gap to control the magnetic attraction of the armature by magnetic saturation of the reduced transverse section, the reduced transverse section having a cross-sectional area related to the cross-sectional area of the primary pole means to saturate at a flux level not substantially greater than the primary pole means.

* * * * *